United States Patent [19]

Alderman

[11] 4,075,807

[45] Feb. 28, 1978

[54] METHOD AND APPARATUS FOR APPLYING SHEET MATERIAL TO A ROOF STRUCTURE

[76] Inventor: Robert Joe Alderman, 812 59th St. NW., Bradenton, Fla. 33505

[21] Appl. No.: 649,911

[22] Filed: Jan. 16, 1976

[51] Int. Cl.[2] ..... E04B 2/28; E04B 2/60; E04F 21/00

[52] U.S. Cl. ..... 52/407; 52/90; 52/478; 52/488; 52/743; 52/748; 156/71; 156/576; 242/86.52

[58] Field of Search ..... 156/71, 577, 575; 242/86.52, 56.9; 52/407, 90, 478, 741, 743, 748, 127, 488

[56] References Cited

U.S. PATENT DOCUMENTS

| | | | |
|---|---|---|---|
| 767,193 | 8/1904 | Witham | 242/56.9 |
| 907,731 | 12/1908 | Buckborough | 156/575 |
| 2,007,374 | 7/1935 | Kuehne | 52/407 X |
| 2,009,512 | 7/1935 | Offult et al. | 52/407 X |
| 2,235,542 | 3/1941 | Wenzel | 52/743 X |
| 2,287,400 | 6/1942 | Wells, Jr. | 52/407 X |
| 2,845,150 | 7/1958 | McBerty | 52/407 X |
| 2,922,539 | 1/1960 | Figge | 156/575 X |
| 3,513,614 | 5/1970 | Studzinski | 52/743 |
| 3,559,914 | 2/1971 | Alderman | 242/86.52 |
| 3,845,602 | 11/1974 | Alderman | 52/741 |
| 3,969,863 | 7/1976 | Alderman | 52/90 X |

FOREIGN PATENT DOCUMENTS

| | | | |
|---|---|---|---|
| 2,315,793 | 10/1974 | Germany | 52/407 |
| 672,297 | 5/1952 | United Kingdom | 52/478 |
| 1,028,906 | 5/1966 | United Kingdom | 52/90 |

*Primary Examiner*—Alfred C. Perham
*Attorney, Agent, or Firm*—Jones, Thomas & Askew

[57] ABSTRACT

A support framework is mounted on the purlins in a partially completed roof structure and is moved along the length of the purlins. A plurality of reels of sheet material are carried by the framework and the sheet material is progressively unrolled from the reels and applied to the purlins as the support framework moves. Loose insulation is blown onto the sheet material and hard sheet roofing material is applied over the sheet material and loose insulation to the purlins as the support framework progresses across the structure.

20 Claims, 5 Drawing Figures

METHOD AND APPARATUS FOR APPLYING SHEET MATERIAL TO A ROOF STRUCTURE

BACKGROUND OF THE INVENTION

The roof structure of an industrial building typically comprises rafter beams which extend parallel to one another across the building and slope from the center of the building down toward its sides, and purlins which extend parallel to each other and which extend across and are mounted on the rafter beams. Hard sheets of exterior roofing material extend over and are attached to the purlins. In the past, when a roof structure of an industrial building was insulated, sheets of insulation material were placed across the purlins and the sheets of hard roofing material were attached to the purlins through the insulation material. the relatively thin sheets of insulation material were applied to the roof structure by the workmen using the sheets of hard roofing material which were already installed in the roof structure as a working surface. The reels of insulation material were first unwound on the hard sheets of roofing material and moved by hand over onto the exposed purlins adjacent the hard roofing material. The sheets of insulation material were stretched to prevent sagging between the purlins, and the hard roofing material was then placed over the insulation material and connected to the purlins.

As set forth in my prior U.S. Pat. No. 3,559,914, it has now become common practice to extend the strips of insulation material along the lengths of the purlins so as to prevent the seams between adjacent sheets of insulation material from being exposed inside the building. The new procedure as set forth in my prior patent has reduced hazards to workmen on the roof by maintaining reels of insulation material in a relatively static and available position on the exposed purlins at all times while the workmen remain on the sheets of hard roofing material, so that the occasions when the workmen might be tempted to walk or climb out on the purlins to place or adjust the sheets of insulation material have been reduced, but the prior art still does not provide the workmen with a safe working surface beyond the installed sheets of hard roofing material adjacent the working area where the reels of insulation material are being placed on the exposed purlins. In addition, the prior art requires that each reel of insulation material be moved and otherwise handled individually, which periodically requires a workman to move each reel individually and progressively across the roof structure. Also, the prior art does not disclose a well insulated roof structure for an industrial building which is inexpensive, and which is safely and expediently installed.

SUMMARY OF THE INVENTION

Briefly described, the present invention comprises an insulated roof structure for an industrial building and a method and apparatus for forming a roof structure. A plurality of reels of sheet material are supported by a framework mounted on the purlins of a roof structure, with each reel positioned over a space between adjacent purlins, and with alternate ones of the reels positioned on one side of the framework and the other reels positioned on the other side of the framework. A worker's platform is supported by the framework between the rows of reels of sheet material, and a winch system carried by the framework pulls the framework along the purlins toward one end of the building structure so as to move the plurality of reels of sheet material progressively and simultaneously along the building structure and pay out the sheet material down between the purlins. A workman on the worker's platform controls the movement of the framework and places loose insulation on the sheet material extending between the purlins. Additional workmen apply hard sheets of roofing material to the purlins over the insulation material and sheet material paid out from the reels carried by the framework.

Thus, it is an object of this invention to provide a method and apparatus for safely, expediently and economically applying sheets of material to the roof structure of an industrial building.

Another object of this invention is to provide a method and apparatus for supporting a worker on a roof structure as the roof structure is being assembled.

Another object of the invention is to provide an inexpensive insulated roof structure for an industrial building.

Another object of the invention is to provide a method and apparatus for safely, expediently and economically applying an insulated roof structure to a building.

Other objects, features and advantages of the present invention will become apparent upon reading the following specification, when taken in conjunction with the accompanying drawing.

DETAILED DESCRIPTION

Figure 1:
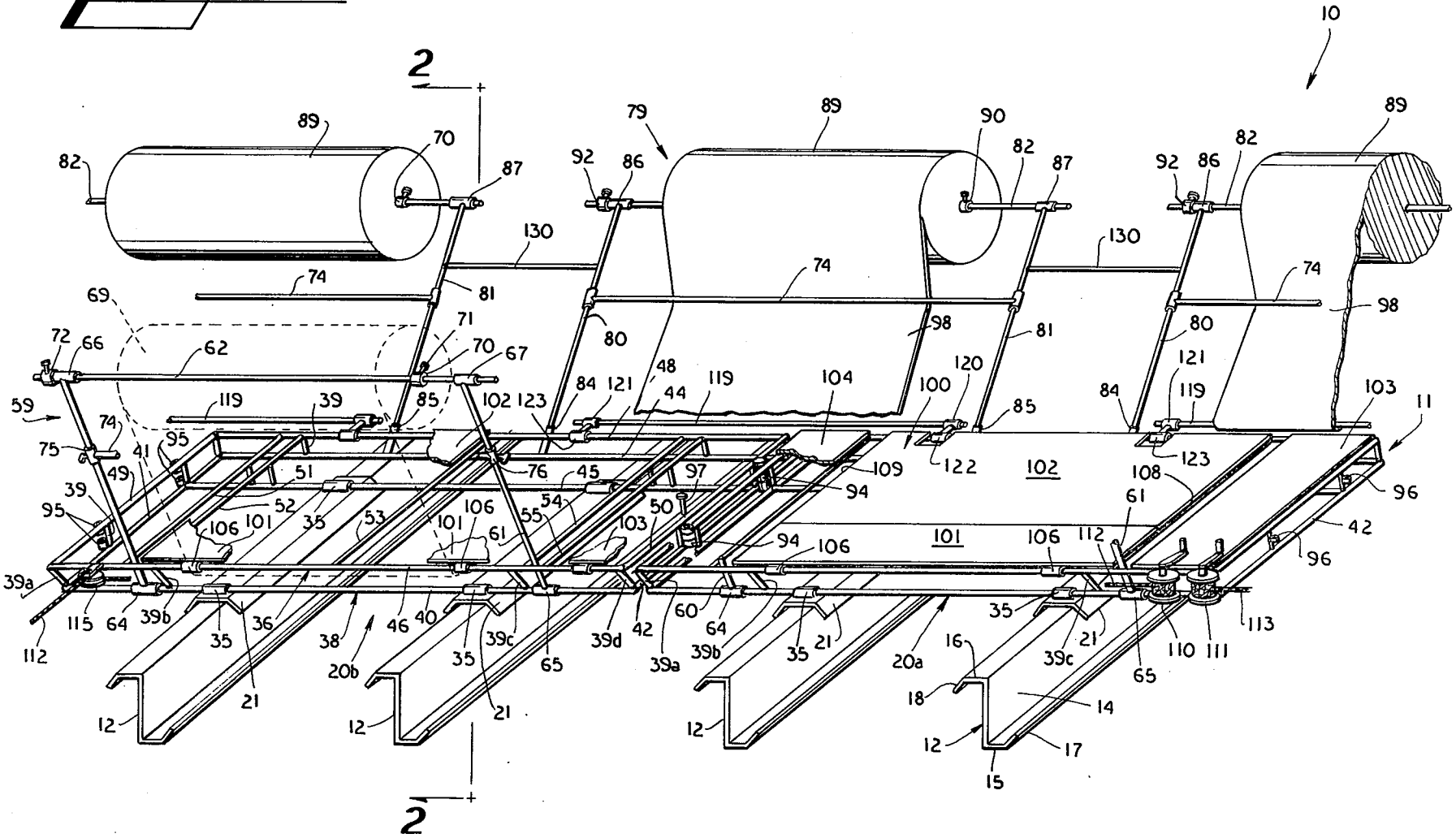
FIG. 1 is a perspective view of the apparatus for applying sheet material to the roof structure of an industrial building, with portions of the apparatus broken away for clarity.

Referring now in more detail to the drawing, in which like numerals indicate like parts throughout the several views, FIG. 1 shows the apparatus 10 for applying the sheet material to a roof structure which includes a framework 11 movable along a plurality of purlins 12 of a partially completed roof structure of a building. Each purlin 12 is approximately Z-shaped in cross section and includes a central web 14, lower flange 15, upper flange 16, and the flanges 15 and 16 are bent back toward web 12 to form rims 17 and 18. In a typical roof structure, the purlins will be equally spaced apart, with the most common spacing being 5 feet.

Figure 3:
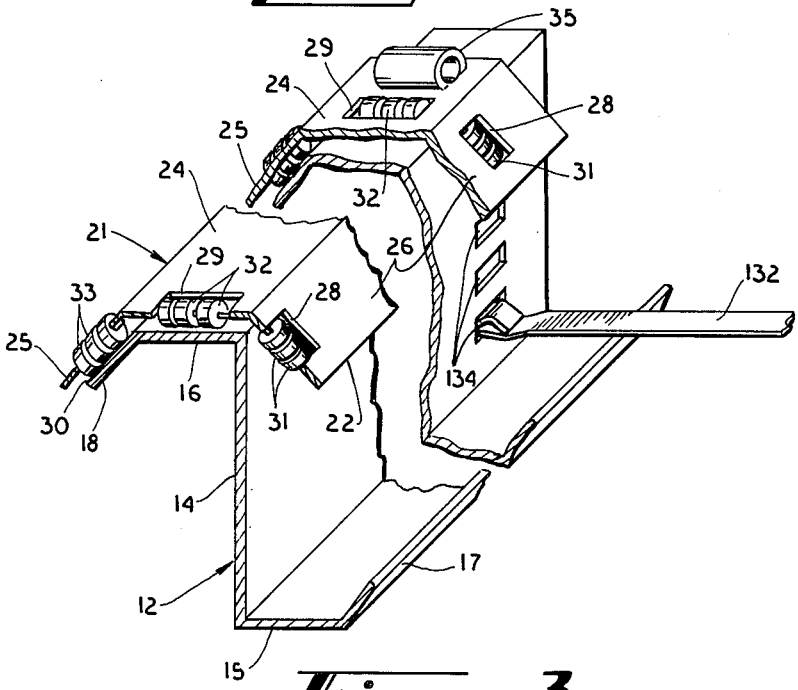
FIG. 3 is a detail illustration of the guide means for the framework of the apparatus.
Figure 4:
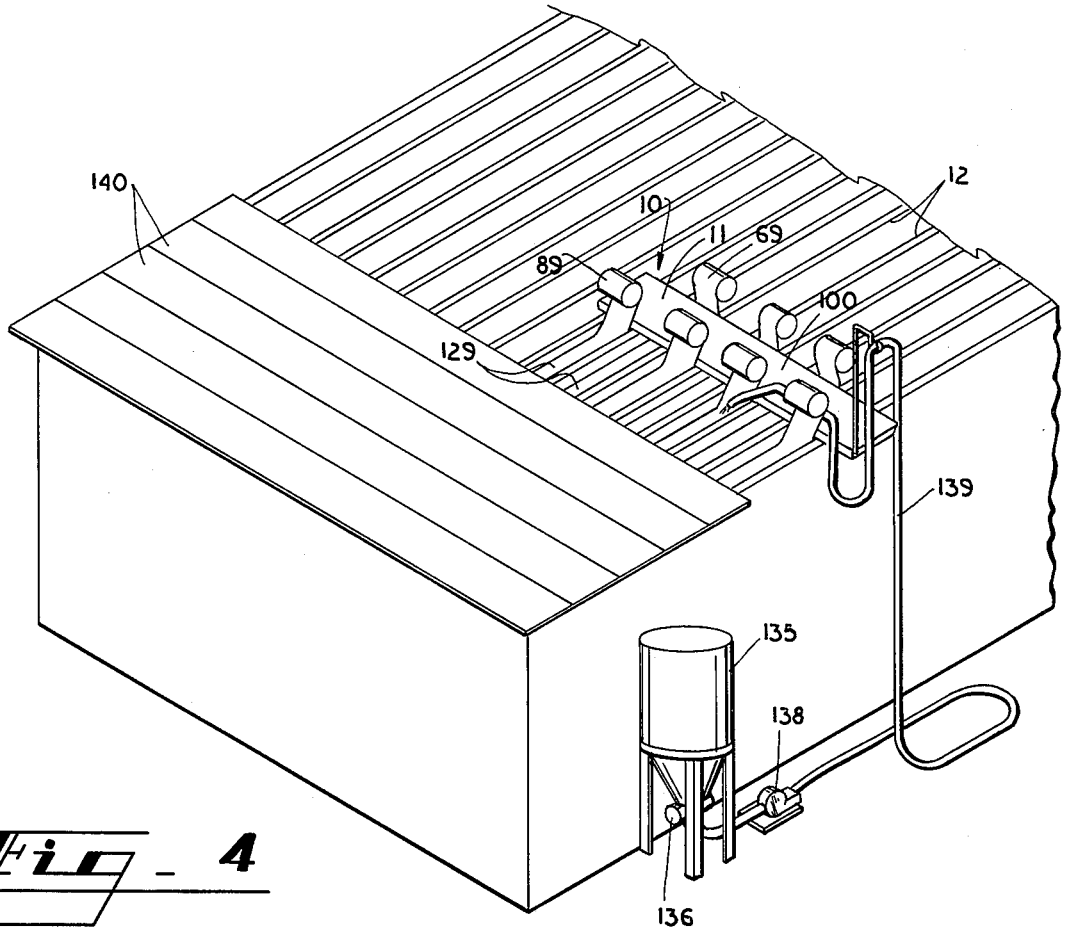
FIG. 4 is a schematic perspective view of a partially completed industrial building and the apparatus for applying sheet material to the roof structure, showing the method of blowing loose insulation into the roof structure.

Framework 11 comprises a plurality of sections such as framework sections **20*a* and 20*b* which are assembled in end-to-end relationship. Each framework section is of a length greater than the space between adjacent ones of the purlins. In the embodiment illustrated, each framework section is 10 feet long so that each section will rest upon adjacent ones of the purlins 12** and will extend approximately 2½ feet beyond the adjacent purlins. Each framework section includes a pair of guide means 21 (FIG. 3) which are mounted on a purlin 12. Each guide means 21 includes a frame 22 which has a central portion 24 and downwardly extending side legs 25 and 26. Slots 28, 29 and 30 are formed adjacent the opposite ends of the frame 22 in the central portion 24 and in the side legs 25 and 26, and wheels 31, 32 and 33 are rotatably mounted in the slots. The wheels 32 are arranged to ride on the upper flange 16 of the purlin while the wheels 31 and 33 are arranged to ride on the rim 18 of the purlin. It will be understood that the purlins 12 are usually mounted so that the lower laterally extending flange 15 extends down the incline of the rafters while the upper laterally extending flange 16 extends up the incline of the rafters so that the central portion 14 and wheels 29 of the frame 22 of the guide means 21 will be sloped downwardly to the right as illustrated in FIG. 3, so that the wheels 33 will be moved under the influence of gravity into engagement with the rim 18 of the purlins. The wheels 31 will not engage the purlins, unless the frame 22 should be reversed in its position on the purlins. Mounting sockets 35 are secured to the opposite ends of the frame 22 for the purpose of mounting the guide means 21 on the framework sections 20*a*, 20*b*, etc.

Each framework section 20*a*, 20*b*, etc. includes an upper frame segment 36 and a lower frame segment 38, with frame segments 36 and 38 formed in a single plane and spaced apart by short framework spacers 39. The lower frame segment 38 of each framework section includes front support rod 40, end tie rods 41 and 42, rear support rod 44 and rear mounting rod 45. Upper frame segment 36 of each framework section includes front platform rod 46, rear platform rod 48, end tie rods 49 and 50 and intermediate tie rods 51, 52, 53, 54, and 55. The short framework spacers are connected between the elements of the lower and upper framework segments as illustrated in the drawing so that the upper framework segment is spaced upwardly from the lower framework segment. It will be noted that no framework spacers 39 are located in the central portion of the framework sections 20*a* and 20*b*, so that a horizontal passage 56 (see FIG. 2) is defined between the upper and lower framework segments 36 and 38 at the central portion of the framework section for the passage therethrough of sheet material.

The guide means 21 are mounted on the framework section by the front support rod 40 and rear mounting rod 46 of the framework sections extending through the mounting sockets 35 of the guide means. The mounting sockets 35 can be rigidly connected to the support rods 40 and 41 by setscrews (not shown), if desired.

The framework spacers 39*a*, 39*b*, 39*c* and 39*d* which extend between the front support rod 40 in the lower frame segment and the front platform rod 46 of the upper frame segment are inclined forwardly with respect to the framework section so that the front platform rod 46 is spaced forwardly with respect to the front support rod 40. Forward reel support assembly 59 includes support arms 60 and 61 and reel support bar 62. The support arms 60 and 61 extend upwardly from bushings 64 and 65, and the bushings are rotatably mounted on front support rod 40 of lower frame segment 38. The upper ends of support arms 60 and 61 terminate in reel support bar bushings 66 and 67, and the ends of reel support bar 62 are received in bushings 66 and 67. A reel of sheet material such as insulation material 69 is mounted on the reel support bar 62, by the reel support bar 62 passing through the center of the reel of sheet material.

Since the framework sections 20*a*, 20*b*, etc. will be inclined with the pitch of the roof of the building, it is necessary to hold the reels 69 against the force of gravity to prevent the reels from sliding along the reel support bar 62. Locking collar 70 is mounted on reel support bar 62 and its setscrew 71 can be loosened and tightened so as to allow the locking collar to be moved along the length of the reel support bar 62 and then locked on the bar. The locking collar 70 is positioned adjacent the desired end position of the reel of sheet material 69, so that the reel will move down the incline of the support bar 62 against the locking collar 70 but will not move beyond this position. In order to keep the reel support bar 62 from moving with the influence of gravity through the bushings 66 and 67 at the upper ends of the support arms 60 and 61, a locking collar 72 is mounted on and locked on the upper end of reel support bar beyond support arm 60. With this arrangement, neither the reel of sheet material 69 nor its support bar 62 will migrate down the slope of the roof as the reel of sheet material is being progressively unwound.

Figure 2:
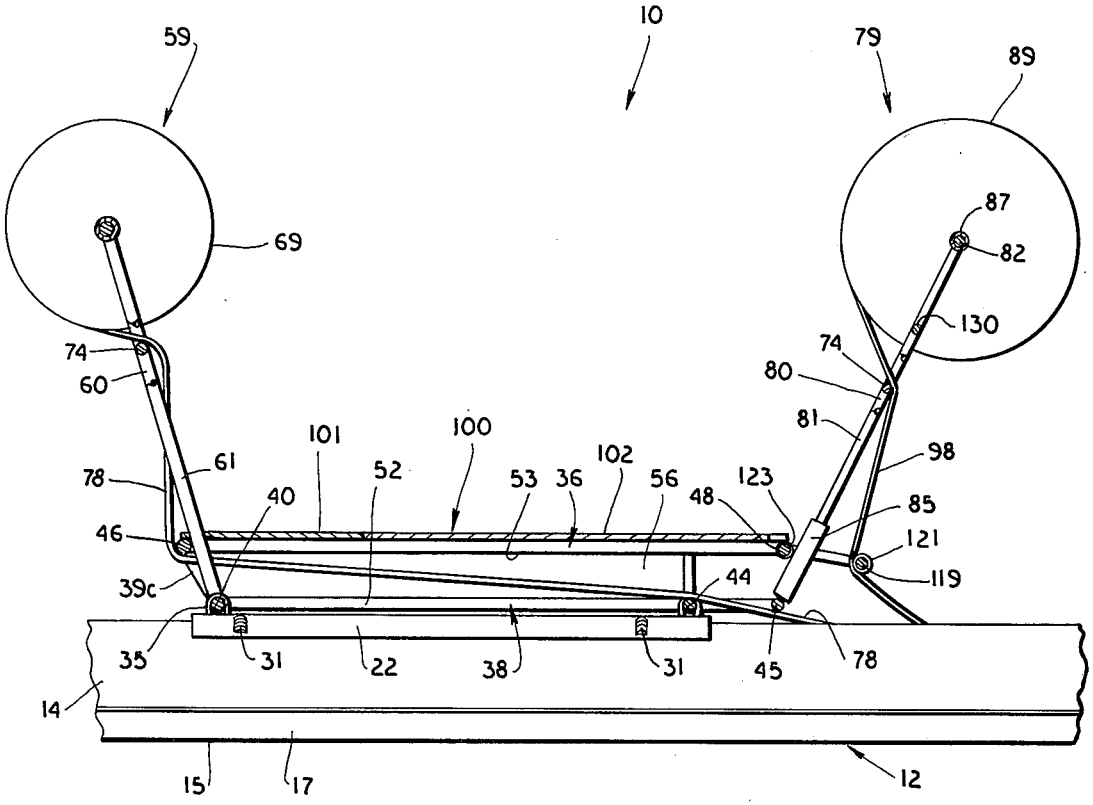
FIG. 2 is a side cross sectional view taken along lines 2—2 of FIG. 1.

Since the front platform rod 46 is displaced forwardly with respect to the front support rod 40, the support arms 60 and 61 normally rest against the front platform rod 46 and will be allowed to slope forwardly and upwardly with respect to the framework section, so that the reel 69 of sheet material will be located approximately over the front portion of the framework section, as illustrated in FIG. 2, and the weight of the reel 69 will tend to hold the forward reel support assembly 59 in the position illustrated.

In order to keep the reel of sheet material 69 from freely unwinding because of the weight of the free end of the sheet material pulling from the reel, an optional adjustable limiting rod 74 is mounted on support arms 60 and 61 below the position of reel 69, with the bushings 75 and 76 extending about the support arms, with each bushing including a setscrew for clamping the limiting rod adjacent the reel 69. The free end 78 of the reel of sheet material passes over the limiting rod 74 and then downwardly to the passage 56 between the upper and lower frame segments 36 and 38 and then rearwardly through the framework section until it passes over the rear support rod 44, whereupon it moves in a downward direction to pass beneath the rear mounting rod 45.

The support arms 60 and 61 of the forward reel support assembly 59 can pivot with respect to the framework section, and tie rods 51 and 52 accommodate the pivotal movement of support arms 60 while the tie rods 54 and 55 accommodate the pivotal movement of support arm 61. With this arrangment the forward reel support assembly 59 can be pivoted down to a convenient storage position when the framework section is being stored, or when the framework section is being lifted onto or off of a roof of a building.

The rear reel support assemblies 79 also include support arms 80 and 81 and reel support bar 82. Support sockets 84 and 85 are rigidly mounted on the rear mounting rod 45 and rear platform rod 48 of the framework section and are inclined upwardly and rearwardly with respect to the framework sections. The support arms 80 and 81 of the rear reel support assembly 79 are telescopically mounted in the openings of the support sockets 84 and 85. Bushings 86 and 87 are rigidly secured to the upper ends of support arms 80 and 81 and the ends of the reel support bar 82 extend through the bushings 86 and 87. A reel of sheet material 89 is mounted on the reel support bar 82 by passing the reel support bar 82 through the center of the reel 89 and then mounting the ends of the reel support bar 82 in the bushings 86 and 87. Locking collars 90 and 92 are attached to the reel support bar 82 to prevent the reel 89 and the support bar 82 from migrating down the incline of the framework. If desired, a limiting rod such as limiting rod 74 of forward reel support assembly 59 can be mounted on the support arms 80 and 81 of the rear support assembly 79 to prevent the reel 89 from inadvertently paying out.

The framework sections 20*a*, 20*b*, etc. are placed in end-to-end relationship with respect to each other on the purlins 12, and the framework sections are connected together by a pair of connectors 94. Each connector 94 includes two spaced sockets 95 attached to a framework spacer at one end of a framework section and a single socket 96 attached to a framework spacer at the other end of a framework section. When the framework sections are placed in abutting end-to-end relationship, the sockets 96 and 95 will mate together and connector pins 97 are inserted down through the aligned socket sections 95 and 96 to lock the framework sections together in a substantially rigid relationship.

A worker's platform 100 is mounted on the support framework. The platform 100 comprises two central sections 101 and 102 and end sections 103 and 104. Central sections 101 and 102 are pivotally connected to front platform rod 46 and rear platform rod 48 by means of bushings 106, while the end sections 103 and 104 are rigidly connected to the upper frame segment 36. A slot 108 is formed between central sections 101 and 102 and end section 103, while a similar slot 109 is formed between central sections 101 and 102 and end section 104. Slots 108 and 109 are in alignment with the spaces between the tie rods 54 and 55 and 51 and 52, to accommodate the pivoting movement of the support arms 60 and 61 of the forward reel support assembly 59.

A pair of winches 110 and 111 are mounted on the forward portion of one of the framework sections, such as framework section 20*a*, and the cable 112 from winch 110 extends in one direction while the cable 113 from the other winch extends in the opposite direction. The cable 112 passes about a pulley 115 which is mounted on one of the framework sections, and the free end of the cable extends from pulley 115 parallel to the purlins to the end of the building structure. The other cable 113 extends about a similar pulley (not shown) mounted on another one of the framework sections, and then passes to the end of the building structure. The winches 110 and 111 can be hand actuated or motor operated, and when the winches are operated to reel in the cables 112 and 113, the support framework assembly will be pulled toward the end of the building along the lengths of the purlins 12. The winches 110 and 111 are located together and at a convenient location for the worker so that the worker on the worker's platform can operate both winches simultaneously to draw both ends of the support framework assembly simultaneously along the purlins.

It will be noted that when the framework sections are mounted on the roof structure, the framework sections are assembled together to form the support framework assembly by inserting the connector pins 97 through the connector sockets 95 and 96 of the connectors 94, and the rear reel support assemblies 79 are mounted in their support sockets. It will be noted that the support arms 80 and 81 of the rear reel support assemblies 79 are mounted in the support sockets 84 and 85 of adjacent ones of the framework sections. In a similar manner, the guide rods 119 for the rear reel support assembly 79 are inserted in their bushings 120 and 121, and the bushings 120 and 121 are pivotally supported by bushings 122 and 123 from the rear platform rod 48 of adjacent ones of the framework sections.

When the support framework assembly is properly mounted on the roof structure, the reels 69 and 89 of the sheet material are mounted on the forward and rear reel support assemblies 59 and 79 by inserting the reel support bars 62 and 82 through the center of the reels and mounting the reel support bars on their support arms of the respective reel support assemblies. The reels 69 and 89 will then be positioned over the openings between adjacent ones of the purlins, with the reels 69 supported by the forward reel support assemblies 59 located over alternate ones of the openings in the purlins, and with the reels 89 supported by the rear reel support assemblies 79 positioned over the other alternate openings between the purlins. The free ends 78 and 98 of the reels of sheet material are then passed in a downward direction to the purlins, with the free end 78 of the forward reels 69 passing downwardly about the front platform rod 46 and then laterally through the opening or passage 56 between the upper and lower frame segments 36 and 38, and then beneath the rear mounting rod 45 and then to the purlins. The free ends 98 of the rear reels 89 move downwardly about the guide rods 119 and then to the purlins. The worker is able to walk along the platform 100 formed by the platform sections of the framework sections and perform various steps in the roof installation process, including adjusting the positions of the sheets of material and adjusting the reels supported by the support framework assembly and operating the winches 110 and 111 which function as means for moving the support framework assembly along the purlins.

Figure 5:
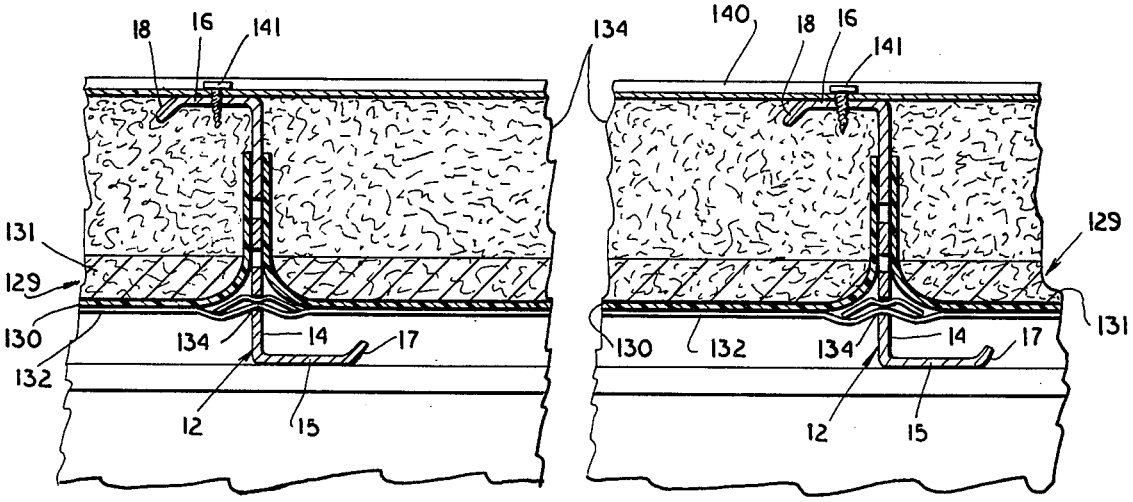
FIG. 5 is a side cross section of the completed roof structure with a portion broken away.

As is illustrated in FIG. 5, the sheet material taken from reels 69 and 89 and applied by the support framework assembly to the purlins can comprise the lamination of air impervious material 130, such as a vinyl, and a thicker layer of matted insulation material 131. As is best illustrated in FIGS. 3 and 5, insulation support means is formed by a plurality of support straps 132 extending through openings 134 in the central webs 14 of the purlins, with the openings 134 arranged in spaced groups along the lengths of the purlins 12 and with the opening 134 of each group being vertically spaced so that the insulation support straps 132 can be located at variable distances from the hard sheet material which forms the exterior roof surface of the roof structure. The sheets of hard roofing material 140 are placed over the purlins 12 and connected to the upper flanges 16 of the purlins with rivets or other fasteners 141.

The sheet material 129 paid out from the reels 69 and 89 has its air impervious layer 130 formed with a width that is substantially wider than the space between the adjacent ones of the purlins 12 so that the ends of the sheets of material will fold in an upward direction so as to be positioned adjacent the central web 14 of adjacent ones of the purlins 12. The thicker web of insulation material 131 tends to hold the side edges of the center material adjacent the central webs of the purlins and to give the sheet material some stability as it lies upon the insulation support straps 132. After the sheet material 129 has been applied to the purlins in the manner illustrated, loose insulation material 134 can be placed on top of the sheet material as illustrated in FIG. 5, or other types of additional insulation material such as blocks or sheets of insulation material can be added. The loose insulation material 134 can be blown into place or manually placed on top of the sheet material.

When the loose insulation material is to be blown into place, a supply of the loose insulation material can be maintained in a supply hopper 135 on the ground adjacent the building or at some other convenient location, a rotary feeder 136 can dispense the loose insulation material from the hopper 135, and a blower 138 can blow the insulation material through a flexible conduit 139 to the framework 11 mounted on the purlins 12. A worker manipulates the end of the flexible conduit 139 so as to direct the flowing loose insulation from the end of the conduit into the spaces between the purlins. The worker can move along the length of the platform 100 and continuously fill the spaces between the purlins with the loose insulation material. If the workers that are working on the hard surface of the roof structure that has already been applied to the building get ahead of the worker on the platform 100 and install the hard roofing material before the worker on the platform is able to fill the spaces between the purlins with the loose insulation material, the worker on the platform can move the end of the flexible conduit 139 up beneath the installed sheets of hard roofing material and blow the loose insulation material up under the sheets of hard roofing material. If desired, a liquid adhesive can be sprayed into or otherwise mixed with the loose insulation material so that the loose insulation material tends to cling to itself and to the purlins and sheet material after it has been placed in the roof structure.

While this invention has been described in detail with particular reference to preferred embodiments thereof, it will be understood that variations and modifications can be effected within the spirit and scope of the invention as described hereinbefore and as defined in the appended claims.

I claim:

1. Apparatus for applying sheets of insulation material or the like to roof structures of buildings of the type including a plurality of purlins arranged in spaced substantially parallel relationship with respect to one another comprising a support framework for mounting on and extending across the purlins, said support framework comprising a plurality of framework sections with each section supported by and extending beyond a pair of adjacent purlins and connected to an adjacent framework section, guide means for guiding said support framework along the purlins, said support framework including a first plurality of reel supports for supporting reels of sheet insulation material over alternate spaces between the purlins and a second plurality of reel supports for supporting reels of sheet insulation material over the other alternate spaces between the purlins, said second plurality of reel supports being displaced rearwardly along the purlins from said first plurality of reel supports.

2. The apparatus of claim 1 and wherein said framework includes a worker's platform and defines passages beneath said worker's platform for the movement therethrough of the sheets of insulation material.

3. The apparatus of claim 1 and further including means for moving said support framework along the purlins.

4. The apparatus of claim 1 and further including winch means for moving said support framework along the purlins.

5. Apparatus for applying sheet material to roof structures or the like which include a plurality of purlins in spaced substantially parallel relationship comprising a framework for mounting on and extending across the purlins, guide means for guiding said framework along the lengths of the purlins, first and second reel support means mounted on said framework with said first reel support means for supporting reels of sheet material at alternate ones of the spaces between adjacent ones of the purlins positioned on one side of said framework and said second reel support means for supporting reels of sheet material at the other ones of the spaces between adjacent ones of the purlins positioned on the other side of said framework, and a worker's platform on the framework, said worker's platform extending between said first and second reel support means.

6. Apparatus for applying sheets of insulation material or the like to roof structures of buildings of the type including a plurality of purlins arranged in spaced substantially parallel relationship with respect to one another comprising a support framework for mounting on and extending across the purlins, guide means for guiding said support framework along the purlins, said support framework including a first plurality of reel supports for supporting reels of sheet insulation material over alternate spaces between the purlins and a second plurality of reel supports for supporting reels of sheet insulation material over the other alternate spaces between the purlins, said second plurality of reel supports being displaced rearwardly along the purlins from said first plurality of reel supports, and a worker's platform extending between said first plurality of reel supports and said second plurality of reel supports, said framework defining passages beneath said worker's platform for the movement therethrough of the sheets of insulation material.

7. The apparatus of claim 6 and wherein said framework comprises a plurality of framework sections with each section supported by and extending beyond a pair of adjacent purlins and connected to an adjacent framework section.

8. The apparatus of claim 6 and wherein said framework comprises a plurality of framework sections connected together in end-to-end relationship across the purlins and with each section supported by at least one purlin in the roof structure.

9. The apparatus of claim 6 and wherein said framework comprises a plurality of framework sections connectable in end-to-end relationship across the purlins with each section individually supported by at least one purlin and each section including at least one of said first reel supports.

10. The apparatus of claim 6 and further including means for adjustably maintaining the reels of insulation material over the spaces between the purlins.

11. The apparatus of claim 6 and wherein said first reel supports are foldable with respect to said support framework.

12. Apparatus for applying sheet material or the like to roof structures of the type including a plurality of purlins arranged in spaced substantially parallel relationship with respect to one another comprising a support framework for mounting on and extending across the purlins of a roof structure, guide means connected to said support framework for guiding said support framework along the purlins, and a worker's platform supported by said support framework, and support framework including means for supporting reels of sheet material over the spaces between adjacent ones of the purlins and for paying out the sheet material into the spaces between adjacent ones of the purlins.

13. The apparatus of claim 1 and wherein said support framework comprises a plurality of framework sections connected in end-to-end relationship, with each framework section being of a length sufficient to extend across a pair of adjacent ones of the purlins and connect to the adjacent framework section at a space between adjacent ones of the purlins, and with each framework section including guide means for engaging a pair of adjacent purlins.

14. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and oppositely laterally extending upper and lower flanges, the improvement therein of each of said purlins defining a plurality of openings along its length through its central web with the openings of the purlins spaced at varying heights in the web of the purlins and with the openings of each purlin being in approximate alignment with the openings of the purlins on opposite sides thereof, a plurality of support straps oriented parallel to one another and extending through aligned ones of the openings of the central webs of said purlins, elongated sheets of material of a width sufficient to substantially span the space between the central webs of adjacent ones of said purlins positioned between and extending parallel to said purlins and resting on said support straps and above the lower flanges of said purlins, sheets of roofing material mounted on said purlins and extending over said sheets of material, and loose insulation material of a thickness approximately equal to the height of the space between said elongated sheets of material and said sheets of roofing material supported by said sheets of material and substantially filling the space between said support straps and said sheets of roofing material.

15. In a roof structure comprising a plurality of purlins each including an upwardly extending central web, said purlins being mounted in spaced parallel relationship with respect to one another, the improvement therein of the upwardly extending central webs of said purlins defining a plurality of openings therein at various heights in the webs of said purlins and with the openings of each purlin being in approximate alignment with the openings of the purlins on opposite sides thereof, and a plurality of insulation support straps oriented parallel to one another and perpendicular to said purlins and extending through the aligned openings of said purlins, elongated sheets of material of a width approximately equal to the spacing between the central webs of said purlins positioned between and extending parallel to said purlins and resting on said support straps, sheets of roofing material mounted on said purlins and extending over said sheets of material, and loose insulating material supported by said sheets of material.

16. The roof structure of claim 15 and wherein said loose insulating material substantially fills the space between the sheets of material and the sheets of hard roofing material.

17. The roof structure of claim 15 and wherein said elongated sheets of material positioned between said purlins comprises a vapor impermeable substance.

18. A method of applying a roof to a building of the type including inclined parallel rafters and a plurality of purlins with upwardly extending central webs and oppositely extending upper and lower flanges mounted on and extending across the rafters comprising extending support means between adjacent ones of the purlins at a level above the lower flanges of the purlins, supporting reels of elongated sheets of the material on the purlins, moving the reels along the purlins and paying out the sheet material from the reels down between the purlins and on said insulation support means as the reels are moved along the purlins with the lengths of the sheets extending parallel to the purlins, placing loose insulation material on the sheets, and applying hard roofing material to the purlins over the loose insulation material.

19. The method of claim 18 and wherein the step of placing loose insulation material on the sheets comprises blowing the loose insulation material onto the sheets.

20. A method of insulating a roof structure on a building of the type including a plurality of parallel purlins comprising mounting a platform on the purlins, supporting reels of elongated sheet material on the platform, simultaneously moving the platform along the purlins and paying out sheet material from the reels supported on the platform to spaces between adjacent ones of the purlins, placing loose insulation material on the sheets of material, and applying hard roofing material to the purlins.

* * * * *

UNITED STATES PATENT OFFICE

CERTIFICATE OF CORRECTION

PATENT NO. : 4,075,807

DATED : February 28, 1978

INVENTOR(S) : Rovert Joe Alderman

It is certified that error appears in the above-identified patent and that said Letters Patent are hereby corrected as shown below:

Column 9, line 7, change the number "1" to read --12--

Column 9, line 2, change "and" to read --said--

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*